United States Patent [19]

Selga

[11] Patent Number: 4,949,415

[45] Date of Patent: Aug. 21, 1990

[54] FABRIC GREETING CARDS AND MEMORY QUILT CONSTRUCTED THEREFROM

[76] Inventor: Betty J. Selga, 4859 Briercrest Ave., Lakewood, Calif. 90713

[21] Appl. No.: 451,883

[22] Filed: Dec. 18, 1989

[51] Int. Cl.[5] ..... A47G 9/02

[52] U.S. Cl. ..... 5/502; 5/482; 40/124.1; 428/102; D6/603

[58] Field of Search ..... 5/482, 500, 502, 485; 40/124.1; 428/102; D6/603

[56] References Cited

U.S. PATENT DOCUMENTS

D. 288,268 2/1987 Durham ..... D6/603

2,808,596 10/1957 Schreiner ..... 5/482

FOREIGN PATENT DOCUMENTS 667756 10/1938 Fed. Rep. of Germany ..... 5/502

OTHER PUBLICATIONS

"Bucilla" Summer 1928 Catalog, p. 18.

*Primary Examiner*—Alexander Grosz

*Attorney, Agent, or Firm*—Charles H. Thomas

[57] ABSTRACT

Greeting cards are produced in the form of fabric patches which are sent to recipients on special occasions. The recipients sew the patches bearing the greeting messages thereon into openings in a fabric matrix to form a memory quilt. The greeting messages are thereby not merely discarded, as is the case with conventional greeting cards formed of card stock, but are saved and incorporated into a useful article.

13 Claims, 1 Drawing Sheet

FABRIC GREETING CARDS AND MEMORY QUILT CONSTRUCTED THEREFROM

BACKGROUND OF THE INVENTION

1. Field of the Invention

The present invention relates to a unique combination of a memory quilt fabricated from greeting cards, and a method of utilizing greeting cards.

2. Description of the Prior Art

Greeting cards are widely used in society today as communications of remembrance to friends and family members, particularly upon holidays and upon other special occasions, such as birthdays and anniversaries. Greeting cards are typically constructed of rectangular sheets of card stock, often folded, and usually preprinted with messages that often includes art work as well as verbal passages of text. The recipients of conventional greeting cards are pleased to receive greeting messages, due largely to a sense of appreciation for being remembered on the occasion of a special event or a holiday by those they hold dear.

Because the cards containing the messages are the tangible manifestation of the thoughts of remembrance and of greetings from persons for whom they have a special fondness or friendship, the recipients of conventional greeting cards often save the cards, although those cards are often packed in drawers or boxes and stored out of sight. After a time, however, an excessive space is required in order to store accumulated greeting cards. The cards are usually thrown away eventually. Consequently, conventional greeting cards typically cease to perform any useful function once they are received, and do create a storage problem especially where storage space is limited.

In a heretofore unrelated activity, many persons who have some degree of skill in the sewing arts construct quilts which are known as memory quilts. In a typical memory quilt construction, patches of fabric material are often printed or embroidered with mottos, poems, proverbs, thought provoking and philosophical sayings and art work, all of which have some special meaning to the person making the memory quilt. Once a sufficient number of patches have been created in such a fashion so as to collectively extend over a suitable area, the edges of the patches are sewn together to form an outer quilt layer. The outer quilt layer is laid atop a soft, padded intermediate layer, which in turn is disposed atop an expansive fabric backing sheet. The three layers are then sewn together with intersecting sets of parallel lines of quilt stitching to form a finished quilt.

Heretofore, however, the construction of memory quilts has been very time consuming and has required considerable skill in the sewing arts to cut and arrange the fabric patches together so that their edges lie along sets of neat, straight lines. Consequently, memory quilts have been produced by only a relatively few number of people who are both skilled enough in the sewing arts to construct such quilts, and who also have the time available to engage in this activity.

SUMMARY OF THE INVENTION

One primary object of the present invention is to provide a use for greeting cards that will serve a useful function and be available for enjoyment long beyond the occasion for which such cards are given. In this connection, the greeting cards of the invention are constructed of quilted fabric material and are sent in a conventional manner to recipients to commemorate enduring friendships and affection for loved ones on holidays and other occasions. Unlike conventional greeting cards, however, the fabric greeting cards according to the invention are not simply discarded or stored away out of sight, but are employed in a useful, attractive manner as recurring reminders of friendship and affection on the part of friends and relatives.

A further object of the invention is to reduce the waste which is now incident to the production, use and disposal of conventional greeting cards. Tons of paper are consumed annually in the production of conventional disposable greeting cards. The production of the card stock from which such greeting cards are manufactured requires the destruction of many acres of timber annually, thus placing an unnecessary drain on limited resource of forest products.

The disposal of conventional gift cards formed of card stock also creates significant environmental problems. Large numbers of conventional gift cards constructed of card stock are disposed of by burning, thereby unnecessarily adding to the amount of smoke and carbon dioxide in the atmosphere. In recent years it has become apparent that the excessive production of carbon dioxide, coupled with the destruction of natural forest land, is creating significant environmental problems. Specifically, the rise in the level of carbon dioxide in the earth's atmosphere is creating a greenhouse effect which is adversely affecting the environment.

Another object of the invention is to provide a means for assembling memory quilts which is simple and which involves the expenditure of very little time. Thus, persons who have the desire to create a memory quilt are now provided with a practical means for doing so, despite having no more than a rudimentary talent for sewing and despite having very little time to devote to the creation of a memory quilt. In our culture at present there are many persons who would like to have the skill to produce a memory quilt, but who simply lack that skill and also lack the time necessary to improve their sewing ability. Those persons, and even persons who are skilled in the sewing arts, often have other responsibilities and obligations which simply leaves them too little time to allow them to create a memory quilt constructed according to traditional techniques.

The present invention brings together solutions to diverse and heretofore unrelated problems by providing a unique combination of a fabric framework including a peripheral border which surrounds a central region and defines therewithin a plurality of openings, and a plurality of fabric patches secured in the openings and containing greeting messages thereon and suitable for use separately as greeting communications.

In one broad aspect the present invention may be considered to be a method of utilizing greeting cards. According to the method of the invention a plurality of greeting cards are constructed from flexible fabric. The greeting cards have greeting messages thereon. The fabric greeting cards are then transmitted to selected recipients. Following receipt the fabric greeting cards are then sewn into openings defined in a matrix having a surrounding fabric border to form a quilt containing fabric greeting messages as panels therein.

The greeting cards of the invention are precut, preferably into panels of rectangular shape, and are preprinted with at least a portion of a greeting message which may be continued on the reverse side. The message may be personalized by adding to the preprinted portion handwritten matter, written in indelible ink or fabric ink or paint. For example, a preprinted message of a poem or saying may be personalized by adding the signature of the sender and the date of the occasion commemorated by the greeting card.

The matrix employed to hold the fabric greeting cards is preferably constructed with a framework that includes an outer, peripheral border formed of lace, braid or any of a variety of trims and of a size sufficient to encompass the area of a quilt suitable for use on a standard, queen size or king size bed. Alternatively, the border may be shaped in a rectangular configuration to produce quilts for beds of smaller sizes, such as for a twin bed or a baby's crib, or for producing quilts which may be hung as wall decorations or utilized as covers for articles of furniture.

Preferably also, the openings in the quilt framework are uniform in size and are rectangular, oval or round in shape. The framework may include intersecting sets of a plurality of decorative strips, using any of a variety of trims. Each of the strips of trim within each set of strips is parallel to the other strips in the same set. Preferably, the sets of trim strips are arranged to form a rectilinear grid defining rectangular openings therein. The strips are sewn together at each intersection where they cross. The framework may be further shaped and stabilized by securing a plurality of blank panels into the rectilinear matrix. The blank panels are interspersed among the openings which are adapted to receive the fabric patches that are first utilized as greeting cards and later inserted into the openings in the matrix.

Preferably, the patches which are employed as greeting cards are constructed of a uniform size from a common quilted fabric and are rectangular in shape. The patches may, for example, be constructed in a uniform size of six inches by eight inches, to approximate the size of a conventional folded greeting card formed of card stock. However, the patches may be formed of virtually any size, and need not necessarily be rectangular. The patches do form a peripheral boundary extending over substantially the same area as one of the openings defined in the fabric framework of the quilt. The fabric patches are preferably manufactured with preprinted messages thereon. The messages are preferably centered within each of the patches and have sufficient room at their borders to allow the addition of personalized material, such as signatures, salutations and dates. Personalized material is preferably added by handwriting with a pen utilizing indelible ink or with a brush using fabric paint.

Each of the message patches is formed of a quilted material and includes sets of intersecting quilting stitches. The perimeters of the message patches are bordered with finishing stitches. Therefore, a recipient of a fabric greeting card formed according to the invention does not have to expend the time and skill required to form quilting stitches nor to otherwise exert the patience and skill necessary to produce a conventional memory quilt.

In another broad aspect the present invention may be considered to be a quilt comprising a fabric framework forming a peripheral border that encompasses a grid defining a plurality of openings therewithin, and a plurality of fabric patches each containing a separate greeting message thereon and each suitable for mailing as a greeting card and for subsequent securement to the grid to cover a selected one of the openings.

The patches may be inserted into the openings and sewn in either by hand or by machine using a very simple running stitch. The openings and the patches are both preferably rectangular in shape and of a uniform size. The patches are formed of a quilted material and the lines of quilted stitching on all of the patches are laid out uniformly, so that they are parallel with the lines of quilted stitching of other patches once the patches are sewn into the framework.

At least some of the greeting messages are typically poems, mottos, or greetings for different holidays. Blank fabric patches are preferably secured within the grid and are interspersed among the openings defined in the fabric framework to shape and to stabilize the framework and to create a larger quilt. For example, for every opening to be filled with a fabric greeting card patch there may be three blank panels permanently secured to the border and to the linear strips of fabric lace forming the grid. In such a configuration initially each strip in the grid is secured to a permanent blank panel on one side, and is open at the opposite side to receive a greeting card patch. Also if desired, the openings adapted to receive the greeting card patches may be initially filled with temporary blank panels using a basting stitch to add further shape and stability to the framework for the quilt and to allow the quilt to be utilized prior to completion. As each greeting card patch is received, the basting stitches on the temporary panel to be utilized may be cut and removed and the greeting card patch may be inserted into the opening in place of the temporary panel. For quilts that do not contain the temporary blank panels, the greeting patches may be attached to the framework with temporary adhesive backed or Velcro attachments to hold them in place until they are permanently sewn in position.

The memory quilt of the invention is ideally suited for saving personal greetings from children as momentos of their childhood. Blank greeting patches can be made available in kits including washable fabric pens or paints. Children have a very unique expression in art. By using these kits to allow children to create their own personal messages, parents and grandparents can save these childhood messages from their children and grandchildren forever. The childrens' message greeting patches are configured for insertion into the memory quilt of the invention.

The invention may be described with greater clarity and particularity with reference to the accompanying drawings.

DESCRIPTION OF THE EMBODIMENT AND IMPLEMENTATION OF THE METHOD

Figure 1:
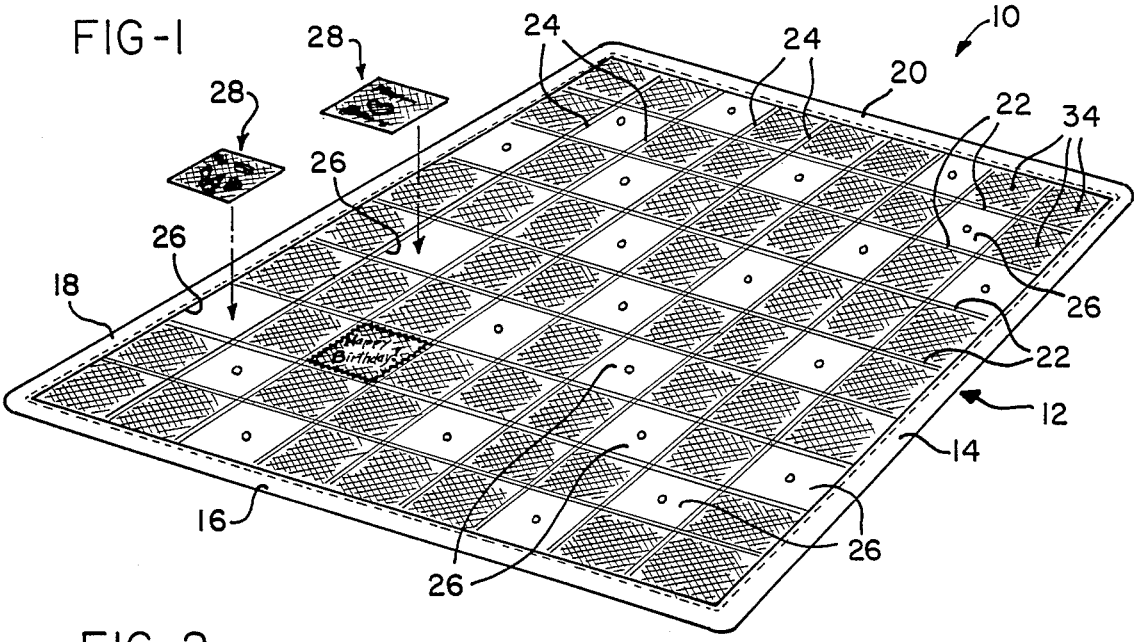
FIG. 1 is a perspective view of a quilt constructed according to the invention.

FIG. 1 illustrates a quilt 10 constructed according to the invention. The quilt 10 is comprised of a fabric framework 12 which forms a peripheral border 13 having a rectangular configuration with encompassing sides 14, 16, 18 and 20. The border 13 is constructed of lace fabric and encompasses a grid formed by sets of lace strips 22 and 24. The strips 22 in the first set of strips are spaced uniformly from each other about eight inches apart, center to center, and extend parallel to the sides 16 and 20 of the border 13 and are secured by stitching at their ends to the sides 14 and 18 thereof. The strips 22 are formed of lace about seven eighths of an inch in width and are mutually parallel to each other. The strips 24 in the other set of strips extend parallel to the lace border sides 14 and 18 and are attached by stitching at their ends to the border sides 16 and 20. The strips 24 are likewise formed of lace and are about seven eighths of an inch wide. The strips 24 are mutually parallel to each other and are perpendicular to the strips 22. The strips 24 may be uniformly spaced apart a distance of about six inches, center to center.

Where each strip 24 crosses a strip 22 the intersecting strips are sewn together at their junctions to thereby define a plurality of openings 26 of a uniform rectangular size approximately six inches by eight inches. The framework 12 thereby defines a plurality of openings therewithin which are depicted at 26 in FIG. 1.

Figure 2:
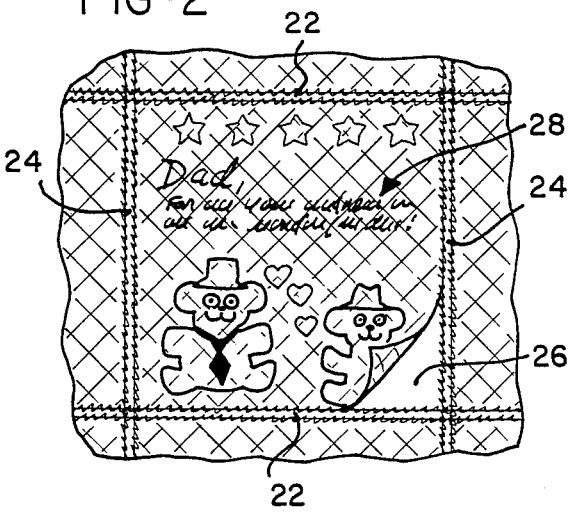
FIG. 2 is a plan detail showing the manner of securement of a fabric greeting card patch as a panel in the quilt of FIG. 1.

The quilt 10 is also comprised of a plurality of fabric patches 28 each containing a separate greeting message thereon and each suitable for mailing as a greeting card. Several different fabric greeting card patches are depicted, for example, in FIGS. 3, 4 and 5. The fabric patches 28 containing the greeting messages are first utilized as greeting cards, and are suitable for subsequent securement to the grid formed by the lace strips 22 and 24 to cover a selected one of the openings 26, as best illustrated in FIGS. 1 and 2.

Figure 3:
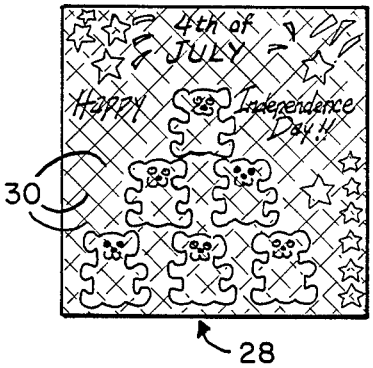
FIG. 3 illustrates one embodiment of a fabric greeting card prior to attachment to the quilt of FIG. 1.
Figure 4:
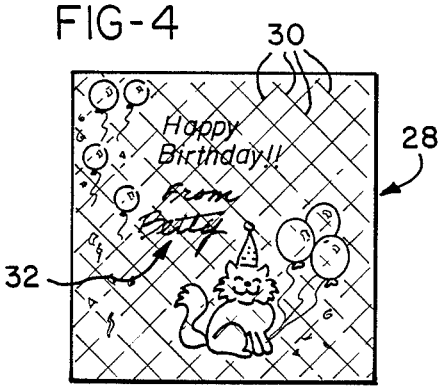
FIG. 4 illustrates an alternative form of fabric greeting card prior to attachment to the quilt of FIG. 1.
Figure 5:
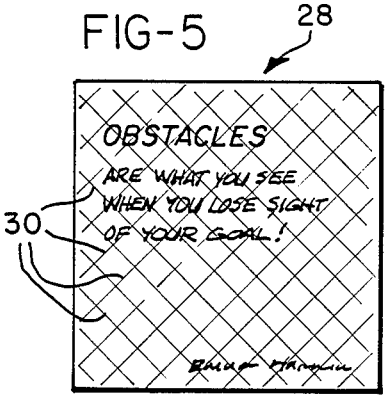
FIG. 5 illustrates another alternative embodiment of a fabric greeting card prior to attachment to the quilt of FIG. 1.

Each of the fabric patches 28 is rectangular in shape, and of a size about six inches by eight inches. Each fabric patch 28 contains a greeting message thereon, suitable for use separately from the framework 12 and the other message patches 28 as a greeting communication. Such greeting cards are unique and interesting since they are formed of quilted fabric, rather than traditional card stock. As illustrated in FIG. 3, some of the greeting message patches 28 are messages of greetings for holidays. FIG. 4 illustrates another message patch 28 which is a greeting for a special occasion, such as a birthday. Still other of the message patches 28 contain mottos or proverbs, as illustrated in FIG. 5.

The message patches 28 are quilted. That is, each of the message patches 28 is comprised of an exposed cloth layer secured to a backing. Padding is interposed between the exposed layer and the backing and the several layers of the material are sewn together with diagonally intersecting quilting stitches indicated at 30 in FIGS. 3, 4 and 5. The edges of the greeting message patch 28 are stitched to prevent fraying and to enhance their aesthetic appearance.

The message patches 28 are all preprinted with a message of greeting. For example, in the message patch of FIG. 4 the preprinted message of greeting includes the words "Happy Birthday!", along with designs such as the printed design of a cat and the balloons as depicted. In addition, the greeting message may include a personalized portion, such as the signature 32 that is handwritten by the sender in indelible ink upon a message patch 28. In other message patches, such as those of FIG. 5, the entire message is preprinted.

To stabilize the framework 12, blank rectangular fabric patches 34 may be secured within the grid formed by the framework 12. The blank patches 34 are interspersed among the openings 26. The patches 34 are blank in the sense that they do not bear any messages, although they may be colored and printed with some repetitive pattern. In the quilt 10 depicted in FIG. 1, the grid formed by the framework 12 may be considered to be divided into quadrants, each containing three blank patches 34 and an opening 26 adapted to receive a greeting message patch 28.

In the method of utilizing greeting cards in accordance with the invention, a plurality of rectangular fabric greeting cards, preferably having dimensions of six inches by eight inches, are constructed all in a uniform size. FIGS. 2–5 illustrate exemplary variations of the messages which may appear on the different fabric greeting cards 28. The fabric greeting cards 28 are then sent through the mail or delivered in person to an intended recipient. The recipient, instead of merely discarding the message patches 28 or relegating them to storage in a closet or file, sews the flexible fabric greeting cards 28 into the openings 26 defined in the matrix formed by the framework 12 between adjacent lace strips 22 and 24.

In the embodiment of the quilt 10, all of the rectangular openings 26 will be covered with message patches 28 once a total of twenty four different messages 28 have been received. As each message patch 28 is received, it is sewn into a selected opening 26 that is defined between a pair of adjacent parallel lace strips 22 and a pair of mutually adjacent parallel strips 24 in the manner depicted in FIG. 2. The message patches 28 are sewn into the openings 26 using a simple running stitch.

Once all of the openings 26 have been filled, the quilt 10 is finished to form a complete memory quilt. The fabric greeting cards 28 are all sewn into the openings 26 that are defined in a matrix having a surrounding fabric border formed by the sides 14, 16, 18 and 20. The memory quilt 10 thereupon contains the fabric greeting message patches 28 as separate panels in the overall quilted structure, interspersed among blank panels 34.

If desired, the openings 26 may be initially covered with temporary blank panel patches to further shape and stabilize the framework 12. The temporary patches may be held in position using a simple basting stitch. The quilt 10 can thereby be utilized during construction before all of the message patches 28 are received and sewn into position in the openings 26. In this case, a temporary panel is removed from an opening 26 as each message patch 28 is received and secured to the framework 12 in the manner depicted in FIG. 2.

Undoubtedly, numerous variations and modifications of the invention will become readily apparent to those familiar with greeting cards and with those familiar with memory quilts. For example, the quilt 10 may be constructed as a two sided structure, so that a portion of a greeting message will appear on one side of a message patch 28 and will be visible from one side of the quilt 10. When the quilt 10 is turned over the remaining portion of the message on that same message patch 28 will be visible. Accordingly, the scope of the invention should not be construed as limited to the specific embodiment and the manner of implementation depicted and described herein, but rather is defined in the claims appended hereto.

I claim:

1. A quilt comprising a fabric framework forming a peripheral border and a plurality of intersecting strips that form a grid defining a plurality of openings therewithin, and a plurality of fabric patches each containing a separate greeting message thereon and each suitable for mailing as a greeting card and for subsequent securement to said grid to cover a selected one of said openings.

2. A quilt according to claim 1 further characterized in that said openings and said patches are rectangular in shape.

3. A quilt according to claim 1 further comprising blank fabric patches secured within said grid and interspersed with said openings.

4. A quilt according to claim 3 further characterized in that said patches are quilted.

5. A quilt according to claim 1 further characterized in that at least some of said greeting messages commemorate different holidays.

6. A combination according to claim 1 wherein said framework is formed of lace.

7. A combination according to claim 1 wherein said framework is formed of braid.

8. A combination of a fabric framework including a peripheral border which surrounds a central region and a plurality of intersecting strips which together define a plurality of openings within said border, and a plurality of fabric patches secured in said openings and containing greeting messages thereon and suitable for use separately as greeting communications.

9. A combination according to claim 8 wherein said openings and said patches are uniform in size.

10. A combination according to claim 9 wherein said openings and said patches are rectangular in shape.

11. A combination according to claim 8 wherein said framework is constructed of lace and said patches are constructed of quilted fabric.

12. A combination according to claim 8 wherein said framework is constructed of braid and said patches are constructed of quilted fabric.

13. A combination according to claim 8 wherein said greeting messages include both preprinted matter and personalized matter written in indelible ink.

* * * * *